US008707518B2

(12) United States Patent
Branning

(10) Patent No.: US 8,707,518 B2
(45) Date of Patent: Apr. 29, 2014

(54) QUIET DOOR HINGE

(76) Inventor: Merle L. Branning, Yorkville, IL (US)

( * ) Notice: Subject to any disclaimer, the term of this patent is extended or adjusted under 35 U.S.C. 154(b) by 0 days.

(21) Appl. No.: 13/295,006

(22) Filed: Nov. 11, 2011

(65) Prior Publication Data

US 2013/0117966 A1 May 16, 2013

(51) Int. Cl.
*E05D 11/00* (2006.01)

(52) U.S. Cl.
USPC ..... 16/273; 16/385

(58) Field of Classification Search
USPC ..... 16/273, 385, DIG. 13, 2.1, 262, 380, 16/274–276
See application file for complete search history.

(56) References Cited

U.S. PATENT DOCUMENTS

| | | | | | |
|---|---|---|---|---|---|
| 179,409 | A * | 7/1876 | Hopkins | 16/273 |
| 1,027,716 | A * | 5/1912 | Fletcher | 16/273 |
| 2,024,985 | A * | 12/1935 | Brantingson | 16/246 |
| 3,015,126 | A * | 1/1962 | Ahlgren | 16/386 |
| 3,991,436 | A * | 11/1976 | Nagase | 16/273 |
| 4,630,332 | A * | 12/1986 | Bisbing | 16/273 |
| 4,720,198 | A * | 1/1988 | DeBruyn | 384/246 |
| 5,463,795 | A * | 11/1995 | Carlson et al. | 16/273 |
| 5,652,694 | A * | 7/1997 | Martin | 361/679.09 |
| 7,290,310 | B2 * | 11/2007 | Yamaguchi | 16/273 |
| 7,500,286 | B2 | 3/2009 | Soviknes | |
| 2013/0104341 | A1 * | 5/2013 | Kenerly et al. | 16/273 |

* cited by examiner

*Primary Examiner* — William Miller
(74) *Attorney, Agent, or Firm* — Michael B. Martin

(57) ABSTRACT

A quiet door hinge assembly may include a first hinge wing having at least two knuckles and a second hinge wing having at least three knuckles. A central pin may be disposed to connect the first and second hinge wings by passing through the knuckles. Non-metallic separators may be placed between the knuckles disposed to preclude direct contact between the knuckles.

13 Claims, 2 Drawing Sheets

QUIET DOOR HINGE

BACKGROUND OF THE INVENTION

The present invention generally relates to door hinges and more particularly to hinges that may be operated quietly without a need for lubrication.

Typical door hinges provide support for a door by interaction between a first hinge member mounted on a door jamb and a second hinge member mounted on a door. The hinge members are provided with metal knuckles that rotate relative to one another as the door repeatedly opens and closes. It is common practice to periodically lubricate a knuckle-to-knuckle interface to reduce wear and to assure quiet operation of the hinge. If lubricant is not applied carefully, some of the lubricant may migrate onto a door surface and cause unsightly discoloration of the door surface. Additionally, continued operation of the door may result in the lubricant being discolored by metal particles that may be worn away from the knuckle-to-knuckle interface. In that case, additional application of lubricant may result in an even more unsightly damage of the door surface.

As can be seen, there is a need for a door hinge that may operated without application of lubrication.

SUMMARY OF THE INVENTION

In one aspect of the present invention, a door hinge assembly may comprise a first hinge wing having at least two knuckles; a second hinge wing having at least three knuckles; a central pin disposed to connect the first and second hinge wings by passing through the knuckles; and non-metallic separators placed between the knuckles disposed to preclude direct contact between the knuckles.

In another aspect of the present invention, a kit for modifying a door and jamb assembly for quiet and lubrication-free operation may comprise two or more hinges with hinge wings configured to fit into pre-existing mortised hinge pockets of the door and jamb, the hinges having knuckles and having non-metallic separators placed between the knuckles disposed to preclude direct contact between the knuckles.

In still another aspect of the present invention, a method for modifying a door and jamb assembly for quiet an lubrication-free operation may comprise the steps of removing a first hinge of the door and jamb assembly; installing a first replacement hinge having hinge wings configured to fit into mortised hinge pockets of the door and jamb; removing a second hinge for the door and jamb assembly; and installing a second replacement hinge having hinge wings configured to fit into mortised hinge pockets of the door and jamb, wherein the replacement hinges have knuckles and have non-metallic separators placed between the knuckles disposed to preclude direct contact between the knuckles. Moreover, the non-metallic separators can be replaced, as needed, to allow for continued lubrication-free operation.

These and other features, aspects and advantages of the present invention will become better understood with reference to the following drawings, description and claims.

DETAILED DESCRIPTION OF THE INVENTION

Figure 1:
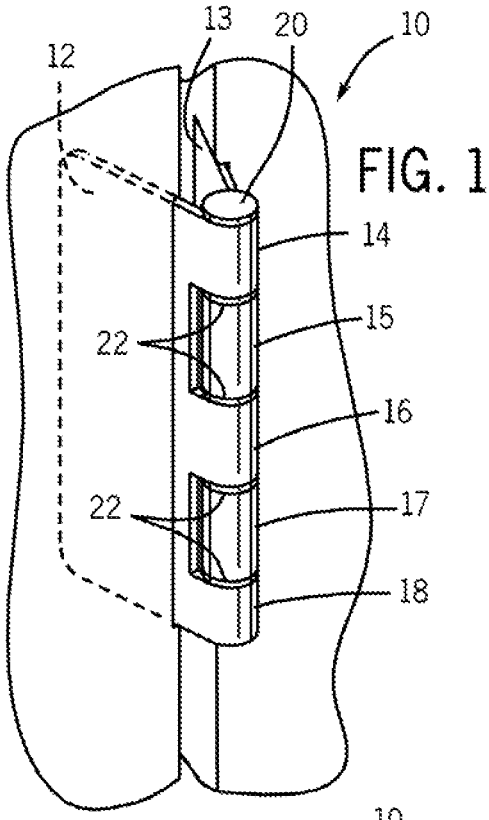
FIG. 1 is a perspective view of a hinge in accordance with an embodiment of the invention.
Figure 3:
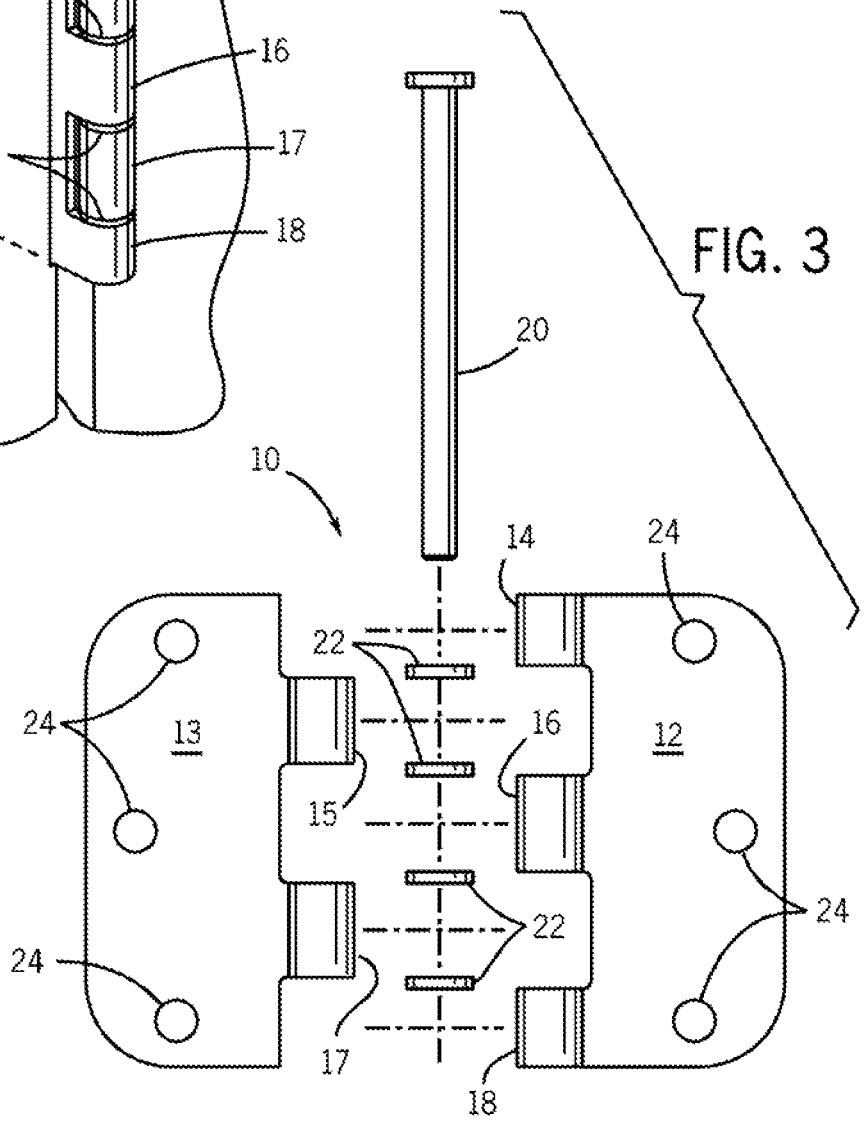
FIG. 3 is an exploded elevation view of the hinge of FIG. 1.
Figure 2:
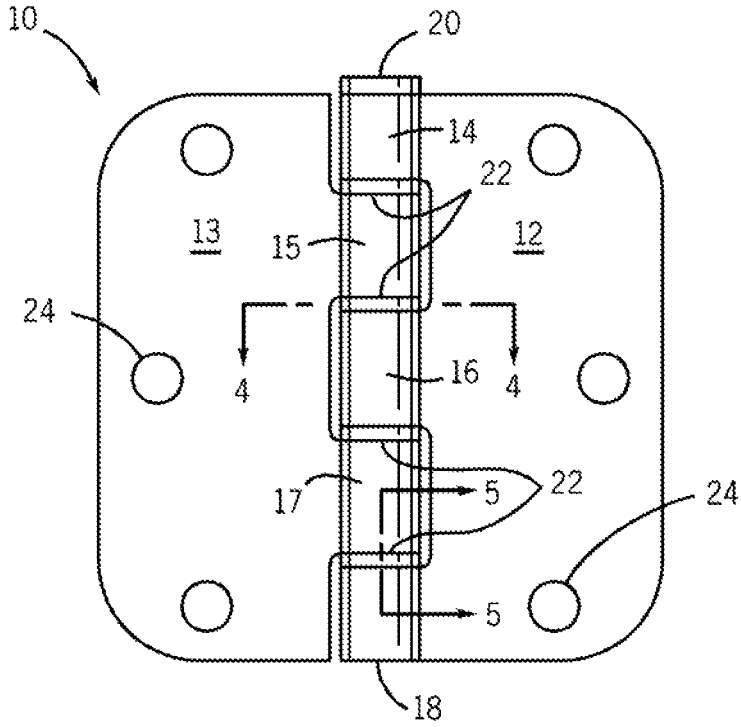
FIG. 2 is a front elevation view of the hinge of FIG. 1.
Figure 4:
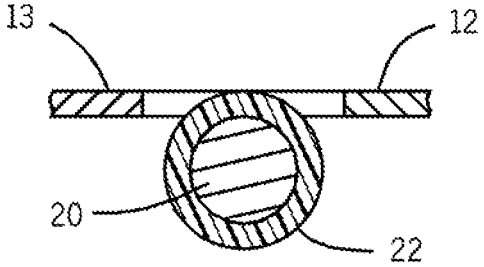
FIG. 4 is a cross-sectional view, taken on line 4-4 of FIG. 2.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide door hinges with non-metallic separators disposed between knuckles of the hinges that preclude direct contact between the knuckles.

Referring to the Figures, an exemplary embodiment of the present invention may comprise a door hinge 10, having a first hinge wing 12 and a second hinge wing 13. A pin 20 may connect the first hinge wing 12 to the second hinge wings 13, e.g., by way of a first cylindrical knuckle 14 of the first hinge wing 12, a first cylindrical knuckle 15 of the second hinge wing 13, a second cylindrical knuckle 16 of the first hinge wing 12, a second cylindrical knuckle 17 of the second hinge wing 13, and a third cylindrical knuckle 18 of the first hinge wing 12. Non-metallic washers or separators 22 may, be positioned between the knuckles and may preclude direct contact between the knuckles. Mounting holes 24 may be provided in the first and second hinge wings 12 and 13.

Figure 5:
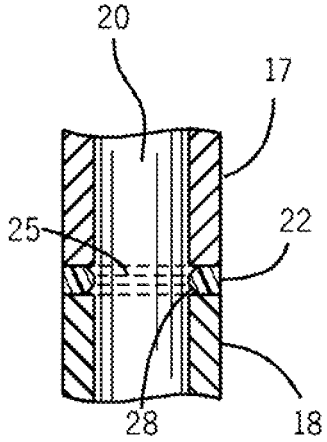
FIG. 5 is a cross-sectional view, taken on line 5-5 of FIG. 2.
Figure 6:
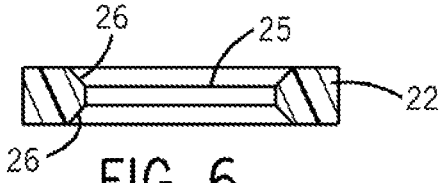
FIG. 6 is a detail cross-sectional view of a separator showing chamfered inside edges.

The separators 22 may be constructed from various non-metallic materials that may allow the knuckles to quietly rotate back and forth across the surface of the separators 22 without a need for lubrication. For example, the separators 22 may be made from plastic such as polytetraflouroethylene, nylon or polyethylene. The separators 22 may be color matched to the color of the hinge wings 12 and 13. The separators 22 may have a toroidal disc shape. Advantageously, the separator 22 may have an internal hole 25 with either chamfered edges 26 as shown in FIG. 6 or radiused edges 28 as shown in FIG. 5 for ease of pin insertion and removal.

A conventional door and jamb assembly may employ two or more conventional hinges to support a door in the jamb. The hinges 10 may be installed into a pre-existing door and jamb assembly by a homeowner to provide quiet and lubrication-free operation. The homeowner may use a kit comprising two or more the hinges 10 with hinge wings 12 and 13 configured to fit into pre-existing mortised hinge pockets of the door and jamb. The kit may be installed by removing a first conventional hinge of the door and jamb assembly, installing a first one of the hinges 10, removing a second conventional hinge from the door and jamb assembly, and installing a second one of the hinges 10. Moreover, the homeowner could replace the separators 22, as needed, to allow for continued lubrication-free operation.

Alternatively door and jamb assemblies may be newly constructed with the hinges 10. In that context, the hinges 10 may be supplied in large quantities to millwork shops where the door and jambs may be assembled with the hinges 10 in lieu of conventional hinges. Home builders may purchase these improved door and jamb assemblies for incorporation into new homes.

It should be understood, of course, that the foregoing relates to exemplary embodiments of the invention and that modifications may be made without departing from the spirit and scope of the invention as set forth in the following claims.

What is claimed is:

1. A door hinge assembly consisting of:

a first hinge wing having two knuckles unitary therewith and mounting holes;

a second hinge wing having three knuckles unitary therewith and mounting holes;

a single plastic separator placed between the knuckles at each knuckle to knuckle interface to preclude direct contact between the knuckles, wherein the separator is a toroidal disc; and a central pin disposed to connect the first and second hinge wings by passing through each of the knuckles and the separators.

2. The door hinge assembly of claim 1 wherein the separators are color matched to the color of the first and second hinge wings.

3. The door hinge assembly of claim 1 wherein the separators are polytetrafluoroethylene.

4. The door hinge assembly of claim 1 wherein the separators are nylon.

5. The door hinge assembly of claim 1:

wherein the knuckles are cylindrical; and wherein the toroidal disc has an internal hole with a chamfered edge.

6. The door hinge assembly of claim 1:

wherein the knuckles are cylindrical; and wherein the toroidal disc has an internal hole with a radiused edge.

7. The door hinge assembly of claim 1 wherein said first and second hinge wings are configured to fit into pre-existing mortised hinge pockets of a door and jamb assembly.

8. A kit for modifying a door and jamb assembly for quiet and lubrication-free operation comprising the door hinge assembly according to claim 1.

9. The kit of claim 8 wherein the separators are polytetrafluoroethylene.

10. The kit of claim 8 wherein the separators are nylon.

11. The door hinge assembly of claim 1 wherein the hinge knuckles are cylindrical.

12. A door hinge assembly consisting of:

a first hinge wing having two cylindrical knuckles unitary therewith and mounting holes;

a second hinge wing having three cylindrical knuckles unitary therewith and mounting holes;

a single nylon separator placed between the knuckles at each knuckle to knuckle interface to preclude direct contact between the knuckles, wherein the separator is a toroidal disc; and a central pin disposed to connect the first and second hinge wings by passing through each of the knuckles and the separators, wherein said first and second hinge wings are configured to fit into pre-existing mortised hinge pockets of a door and jamb assembly.

13. A kit for modifying the door and jamb assembly for quiet and lubrication-free operation comprising the door hinge assembly according to claim 12.

* * * * *